US005499719A

United States Patent [19]

Lindee et al.

[11] Patent Number: 5,499,719

[45] Date of Patent: Mar. 19, 1996

[54] TAKEAWAY/CORRECTION CONVEYOR SYSTEM FOR FOOD PRODUCT MACHINE

[75] Inventors: Scott A. Lindee, New Lenox; David M. Hansen, Orland Park, both of Ill.

[73] Assignee: Formax, Inc., Mokena, Ill.

[21] Appl. No.: 387,324

[22] Filed: Feb. 13, 1995

[51] Int. Cl.[6] ..... B07C 7/04

[52] U.S. Cl. ..... 209/703; 209/705; 209/645; 209/942; 198/435

[58] Field of Search ..... 209/703, 705, 209/645, 925, 922, 936, 923, 941, 942; 198/369.1, 369.2, 435

[56] References Cited

U.S. PATENT DOCUMENTS

| | | | |
|---|---|---|---|
| 2,636,603 | 4/1953 | Feick et al. | 209/941 X |
| 3,595,389 | 7/1971 | Morgan et al. | 209/705 |
| 3,954,166 | 5/1976 | Ives et al. | 198/435 X |
| 4,375,855 | 3/1983 | Floyd | 209/705 |
| 4,426,074 | 1/1984 | Fischer | 209/925 X |
| 4,541,824 | 9/1985 | Müller | 198/435 X |
| 5,205,417 | 4/1993 | Herren | 209/705 X |

*Primary Examiner*—D. Glenn Dayoan

*Attorney, Agent, or Firm*—Dorn, McEachran, Jambor & Keating

[57] ABSTRACT

A stand-alone takeaway and correction conveyor system for a food loaf slicer or other food product machine that produces groups of food products that must be held to close tolerance as to weight or some other readily measurable characteristic includes two conveyors, one for reject groups and one for acceptable groups. The two conveyors are mounted on one base, in spaced parallel relation to each other, with the reject conveyor above the accept conveyor. Both conveyors are driven, at related speeds, from one drive; the drive is mounted in the base and is energized and controlled, as to speed, from the food product machine. The conveyor for acceptable groups has a pivotal outboard section to allow for service of packaging equipment without moving the system. Both conveyors have eccentric mounts to compensate for large elevation differences in packaging equipment. A correction tray is used for correction of reject groups of food products. Controls on the base enable an operator to stop the food product machine and the conveyors and to jog the reject conveyor.

11 Claims, 4 Drawing Sheets

TAKEAWAY/CORRECTION CONVEYOR SYSTEM FOR FOOD PRODUCT MACHINE

In many food processing plants there are one or more food product machines, particularly high speed slicers, that produce groups of food products; those groups may be stacked vertically or may be shingled. The groups of food products, usually groups of food slices, are supplied to packaging equipment to be packaged for shipment to retail establishments, either stores or restaurants. Different packaging machines or other packaging equipment may be used. The food product groups must be maintained within close tolerances, particularly as to weight; under-weight groups constitutes a potential fraud on the ultimate users and overweight groups may represent an appreciable loss of revenue to the plant operator.

Even with the most sophisticated and technologically advanced controls, the slicing machines and like food product machines that produce the groups of food products cannot always maintain those groups within the preset tolerance limits. This is particularly true when the food product machine first starts in operation and again whenever there is any change in operation, such as a change from one food loaf to another in the operation of a food loaf slicer or a change of bacon slabs in a bacon slicer. Moreover, even those food products that are within the preset tolerance, known as "accept" groups, must be transported to a packaging station or other utilization location. That location, for practical reasons, is usually spaced some distance from the food product machine. Different packaging machines or other packaging equipment at the utilization location may have substantially different elevation requirements.

To minimize waste, it is desirable to correct any out-of-tolerance or "reject" food product groups. The corrected groups of food slices or other food products can then be put into the stream of originally correct groups and sent on to a packaging location or other utilization position.

SUMMARY OF THE INVENTION

It is a principal object of the invention, therefore, to provide a new and improved takeaway/correction conveyor system for a high speed food slicer that incorporates effective provisions for keeping correct groups of food slices or other food products separate from reject groups of the same food products and that facilitates correction of the reject groups and amalgamation of corrected groups with the original accept groups.

Another object of the invention is to provide a new and improved takeaway/correction conveyor system that is a complete stand-alone apparatus, adaptable to operator control from either side of the apparatus and usable with a variety of different food product machines and different packaging machines, requiring only electrical connections to a food product machine.

A further object of the invention is to provide a new and improved self-contained takeaway/correction conveyor system for use with a food product machine, and with a variety of packaging equipment which system is relatively simple, durable, and easy to service and which facilitates maintenance of the packaging equipment without moving the conveyor system.

Accordingly, the invention relates to a stand-alone takeaway/correction conveyor system for conveying a series of groups of food products, usually food slices, from a food product machine that produces the food product groups to a utilization position, the food product machine including measuring means for measuring (weighing) the groups to distinguish reject groups from accept groups. The food product machine has output means for delivering the reject groups to a predetermined reject location and the accept groups to a predetermined accept location displaced from the reject location. The takeaway/correction conveyor system comprises a base, a reject conveyor mounted on the base and having an input end aligned with the reject location of the food product machine, and an appreciably longer accept conveyor mounted on the base and having an input end aligned with the accept location of the food product machine; the output end of the accept conveyor is at a preselected utilization position. Both are mounted on a common base. A correction receptacle, usually a tray, is positioned adjacent the reject and accept conveyors, so that an operator can divert reject groups from the reject conveyor to the correction receptacle, correct the reject groups at the correction receptacle to form accept groups therefrom, and deposit the corrected accept groups on the accept conveyor. Electrically actuated drive means, in the base, drive the reject conveyor and the accept conveyor at related speeds. First control means, on the base, interconnecting the takeaway/correction conveyor and the food product machine, are provided for interrupting operation of the food product machine; second control means, on the base and connected to the drive means, are used to interrupt operation of the conveyors and of the food product machine.

DESCRIPTION OF THE PREFERRED EMBODIMENTS

Figure 1:
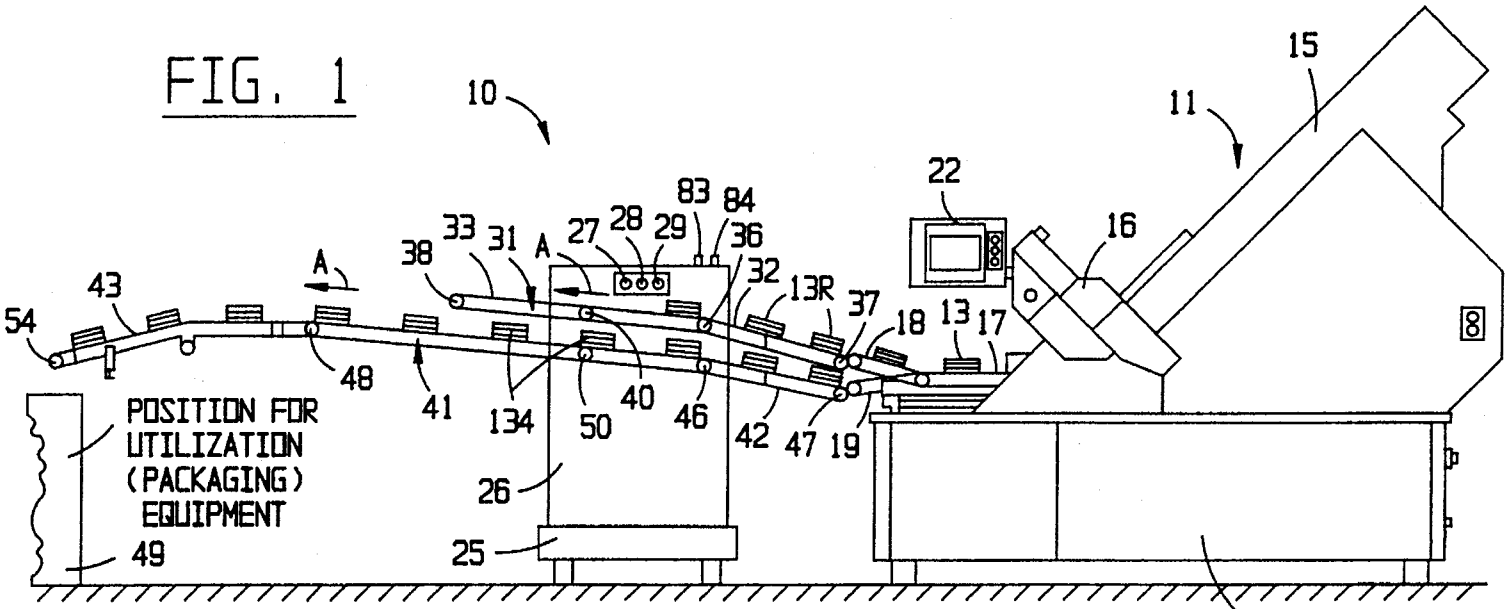
FIG. 1 is a side elevation view of a takeaway/correction conveyor system constructed in accordance with a preferred embodiment of the invention, operationally connecting a high speed food loaf slicing machine to a utilization position.
Figure 2:
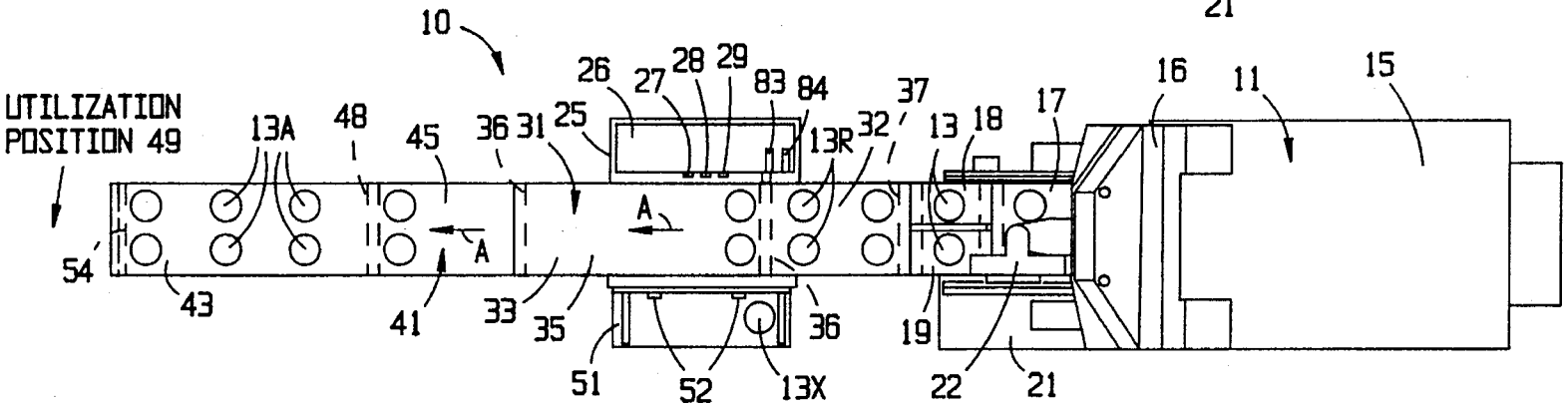
FIG. 2 is a plan view of the apparatus of FIG. 1.

FIGS. 1–5 illustrate a takeaway/correction conveyor system 10 for use in conveying a series of groups of food products from a food product machine to a utilization position. The food product machine 11, FIGS. 1 and 2, may be a food loaf slicing machine or may be any of a variety of different food product machines capable of producing groups of food slices or other food products. As illustrated in FIGS. 1 and 2, machine 11 is the food slicing machine disclosed and claimed in four co-pending U.S. patent applications assigned to Formax, Inc., the assignee of this application. Those four U.S. patent applications are:

Ser. No. 08/320,759, filed Oct. 11, 1994, inventors Scott A. Lindee, Glenn A. Sandberg and Wilbur A. Janssen, entitled "Slicing Machine for Two or More Food Loaves";

Ser. No. 08/320,752, filed Oct. 11, 1994, inventors Scott A. Lindee and David M. Hansen, entitled "Slicing Station for a Food Loaf Slicing Machine";

Ser. No. 08/320,749, filed Oct. 11, 1994, inventors Arthur A. Johnson, Scott A. Lindee and Glenn A. Sandberg, entitled "Conveyor/Classifier System for Versatile Hi-Speed Food Loaf Slicing Machine";

Ser. No. 08/320,750, filed Oct. 11, 1994, inventors Scott A. Lindee, Wilbur A. Janssen and Thomas C. Wolcott, entitled "Method of Manufacturing Food Loaf Slice Groups".

Food product machine 11 produces a series of food product groups 13; actually, machine 11 usually produces two side-by-side series of groups of food slices 13, as best shown in FIGS. 1 and 2. Machine 11, FIGS. 1 and 2, may include a loaf feeder mechanism 15 for feeding two (or more) food loaves into a slicing head 16. Slicing head 16 cuts slices from the food loaves from feeder mechanism 15; the slice groups 13 move on to a weighing conveyor 17 on which the food slice groups are weighed and then pass on to two output conveyors 18 and 19.

Output conveyors 18 and 19 of machine 11 each have a pivotally elevated reject position (see conveyor 18 in FIG. 1) and a pivotally lowered accept position (see conveyor 19 in FIG. 1); their positions are controlled by the weighing action that occurs as the food product groups 13 traverse the measuring (weighing) conveyor 17. All of the operating mechanisms 15–19 of machine 11 are mounted on a base 21, and machine operation is controlled from a control unit 22 mounted on slicing head 16. For further details of food product machine 11, see the co-pending patent applications referred to above.

Takeaway/correction conveyor system 10, FIGS. 1–5, includes a base that comprises a pedestal 25 on which a housing 26 is mounted; housing 26 projects upwardly from pedestal 25. Three control switches are mounted on the upper part of housing 26, as shown in FIGS. 1, 2, 3 and 5. They include a food product machine STOP switch 27, to stop the conveyors of machine 11 (e.g., conveyors 17–19), an EMERGENCY STOP switch 28 that stops all operations in machine 11, and a JOG switch 29 to advance the conveyors of system 10 (described hereinafter) a short distance each time the switch is actuated. There are two conveyors, a reject conveyor 31 and an accept conveyor 41, as described hereinafter.

As shown in FIGS. 1–5, reject conveyor 31 includes a conveyor belt 35 having an input end 32 and an output end 33. Belt 35 of reject conveyor 31 moves in the direction of the arrow A. Belt 35 engages two idler rollers 36 and 38 and a drive roller 37. Idler roller 36 is eccentrically mounted. There is an additional eccentric support 40 for reject conveyor 31.

Accept conveyor 41 includes a conveyor belt 45 having an input end 42 and an output end 43. The output end 43 of accept conveyor 41 is located above a packaging or other utilization position 49. Like reject belt 35, accept belt 45 moves in the direction of arrow A. In system 10 accept conveyor 41 is spaced vertically from and located a short distance below reject conveyor 31. Belt 45 of accept conveyor 41 engages a plurality of idler rollers 46, 48 and 54, and a drive roller 47. Idler roller 46, like idler 36, is eccentrically mounted. There is an additional eccentric support 50 for conveyor 41. By providing two eccentric supports (36 and 40) for most of the length of reject conveyor 31, and two similar eccentric supports (46 and 50) for accept conveyor 41, the two conveyors can be adjusted to compensate for large changes in elevation at utilization position 49 while maintaining adequate spacing between the accept and reject conveyors 31 and 41 of system 10.

Figure 3:
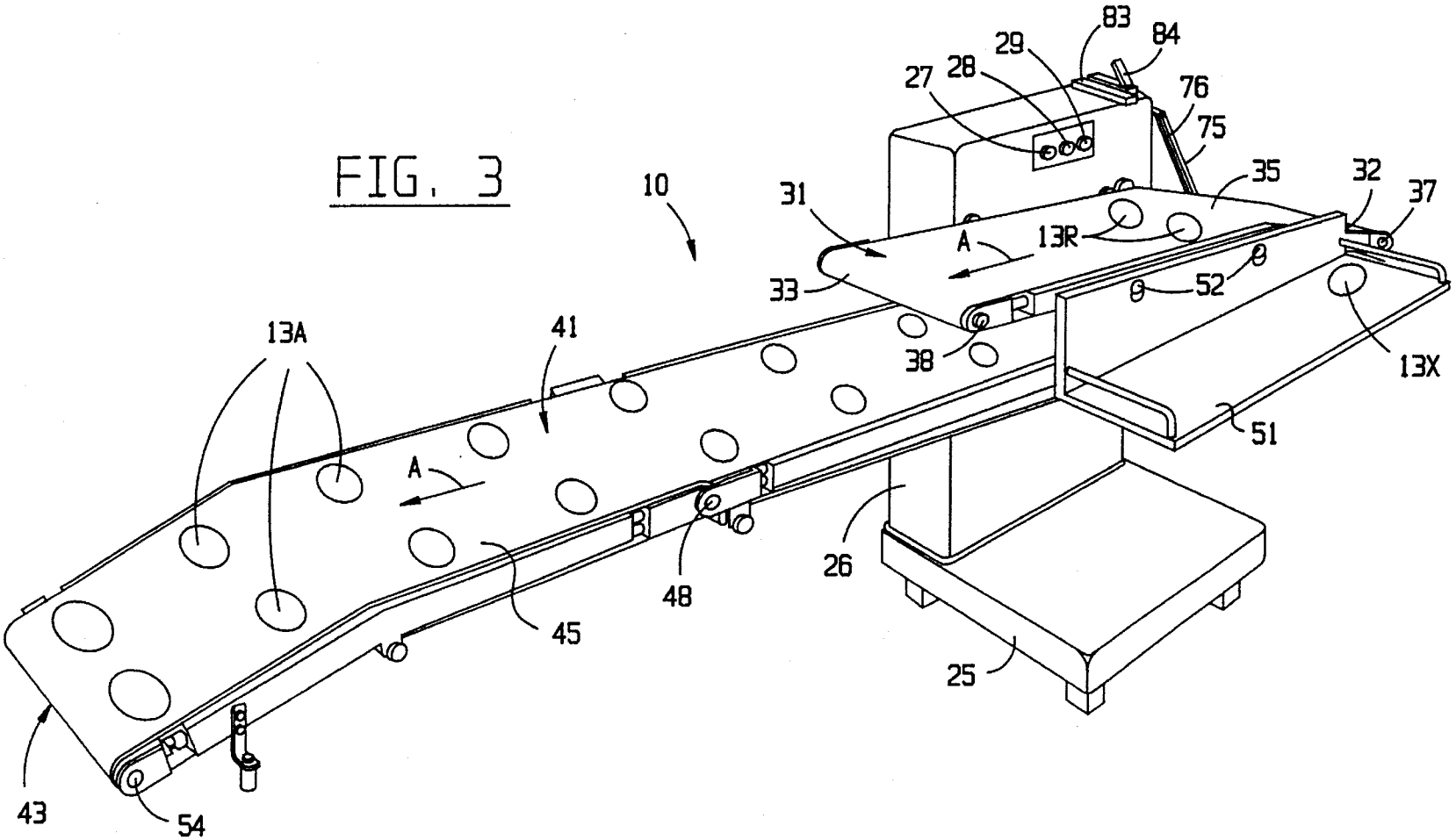
FIG. 3 is a perspective view of the takeaway/correction conveyor system of FIGS. 1 and 2.
Figure 4:
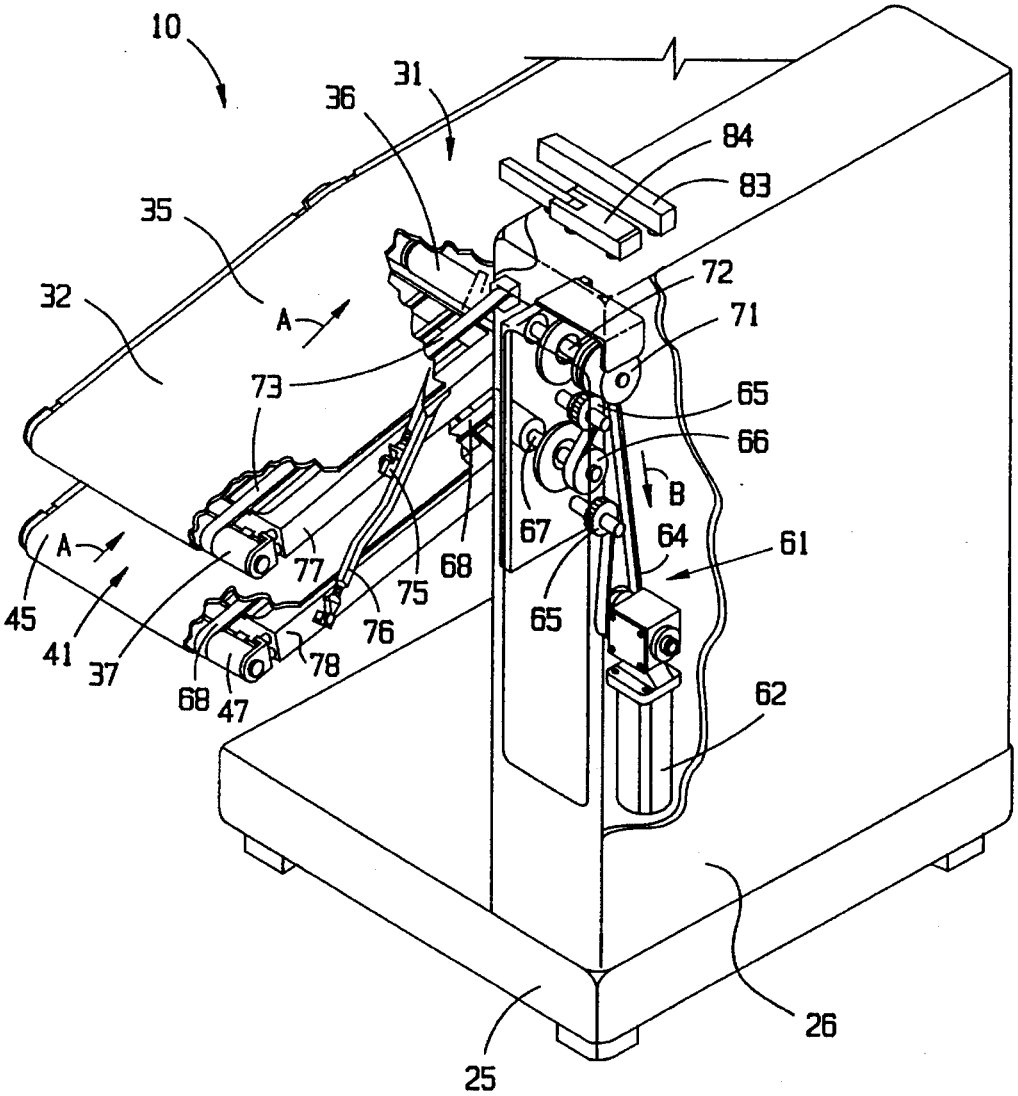
FIG. 4 is a detail perspective view of the drive for the conveyor system of FIGS. 1–3 taken from the opposite side of the system and with some members cut away to aid in explanation.
Figure 5:
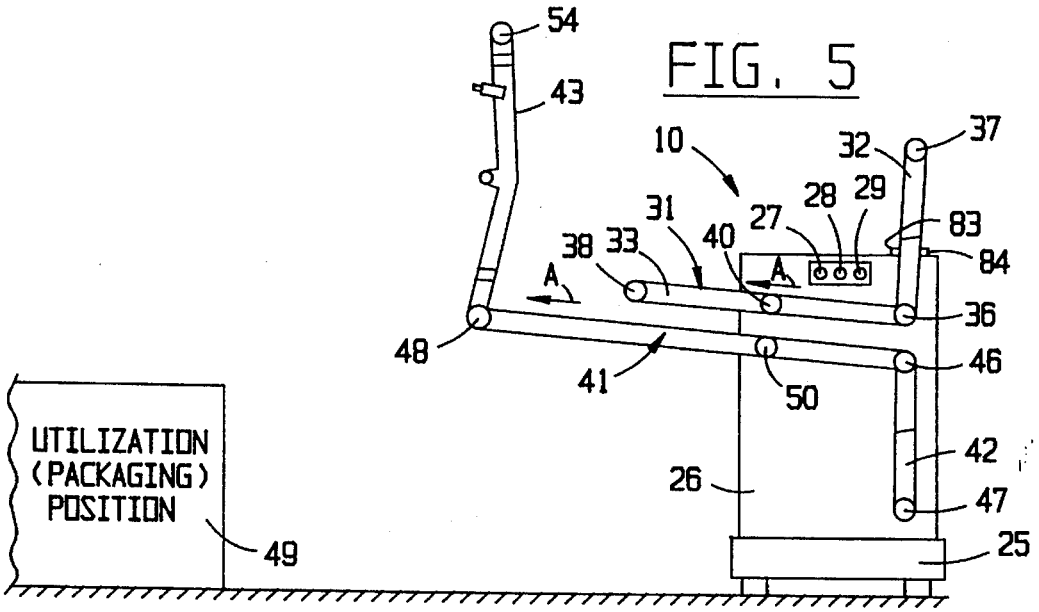
FIG. 5 is a side elevation view of the takeaway/transfer conveyor system of FIG. 1 with input conveyors in position for clean-up and with the "acceptable" conveyor elevated for maintenance of equipment at the utilization position.

The takeaway/correction conveyor system 10 also includes a makeweight tray 51, sometimes referred to as a correction receptacle; tray 51 is shown in FIGS. 2 and 3 but has been omitted in FIGS. 1, 4 and 5 so that other components of system 10 can be seen. Tray 51 is mounted on the frame of reject conveyor 31 by two fixed hangers 52 so that the tray can be readily removed from system 10 for cleanup and related purposes.

The drive 61 for conveyor system 10 is best shown in FIG. 4. It comprises a servomotor 62 that is electrically energized by a connection (not shown) from the food product machine 11. The speed of motor 62 is controlled by the control system of machine 11, so that conveyors 31 and 41 of system 10 can be driven at speeds correlated to the speed of the output or transfer conveyors 18 and 19 of the food product machine.

Motor 62, FIG. 4, drives a timing belt 64 in the direction of arrow B. Belt 64 passes around a first idler pulley 65 to engage the drive pulley 66 of accept conveyor 41. Drive pulley 66 is affixed to one end of a drive shaft 67 for accept conveyor 41. A secondary timing belt 68 is driven from shaft 67; belt 68 engages and drives the drive roller 47 for the conveyor belt 45 of accept conveyor 41. From drive pulley 66 the main drive belt 64 extends around a second idler pulley 65 into engagement with the drive pulley 71 of reject conveyor 31. Drive pulley 71 is affixed to a drive shaft 72; a conveyor drive belt 73 extends from shaft 72 to the drive roller 37 of conveyor 31.

The takeaway/correction conveyor system 10 further includes an adjustable-length support arm or hanger 75 for the input end 32 of reject conveyor 31. One end of arm 75 is secured to housing 26; the other end of arm 75 is releasably connected to a frame member 77 of reject conveyor 31; see FIG. 4. Similarly, an adjustable-length support arm 76 supports the input end 42 of accept conveyor 41. One end of arm 76 is secured to housing 26 and the other end is releasably connected to a frame member 78 for accept conveyor 41 as shown in FIG. 4. The lengths of arms 75 and 76 are made adjustable so that the input ends of conveyors 31 and 41 can be accurately aligned with the operating positions of the output conveyors 18 and 19 of the food product machine 11; see FIG. 1.

When the food product (slicing) machine 11 and the takeaway/correction conveyor system 10 are placed in operation they are aligned with each other and with utilization position 49 in the manner illustrated in FIGS. 1 and 2. Slicing machine 11 produces successive groups of food slices 13, two groups at a time. The first few slice groups are likely to be low in weight, relative to predetermined weight tolerance limits; accordingly, those groups are delivered to reject conveyor 31 as reject groups 13R. One or more food products (slices), usually from the first food product group produced by machine 11, are promptly removed from conveyor 31 and stored on tray 51 as extra food products 13X (FIGS. 2 and 3).

With continued operation, machine 11 produces groups of food slices (products) that are within the preset tolerance limits. These acceptable food product groups 13A are discharged from the output conveyors 18 and 19 of machine 11 onto the input end 42 of accept conveyor 41. Conveyor 41 transports the accept groups 13A to the packaging machine or other equipment at the utilization location 49 at the discharge end 43 of conveyor 41.

Meanwhile, there are likely to be some reject groups 13R on reject conveyor 31. The machine operator takes those reject groups from conveyor 31 and puts them on tray 51. One or more of the extra food products 13X are added to underweight groups. Or the operator may remove a slice (or part of a slice) to bring an over-weight food product group into tolerance, adding the removed slice to the extra food products 13X. A scale (not shown) should be provided on tray 51 (FIGS. 2 and 3); the scale may be affixed to the tray or may be a separate, removable device. The operator places the corrected food product groups on acdept conveyor 41; they are now indistinguishable from other accept stacks 13A. During continued operation of machine 11 more out-of-tolerance food product groups 13R may be produced. The operator of system 10 handles them in the same way. If the controls of machine 11 are actuated to modify the speed of machine operation, the speed of motor 62 (FIG. 4) is similarly modified because that motor is electrically linked to the food product machine.

At the end of any operational interval the conveyor system 10, like any other food processing machine, requires cleanup. For cleanup the two hangers 75 and 76 (FIG. 4) are disconnected from the input ends 32 and 42 of conveyors 31 and 41 respectively. The input end 42 of accept conveyor 41 drops down, as shown in FIG. 5. The input end 32 of reject conveyor 31 is raised until it encounters a stop 83 and is held in position against the stop by a latch 84 that is extended out to engage the conveyor. In this way, a space is cleared between system 10 and machine 11, permitting access to both for cleanup purposes. Similarly, the output end 43 of accept conveyor 41 may be raised to the position shown in FIG. 5, pivoting at the idler roller 48. This permits access to and maintenance of equipment at utilization position 49 without moving system 10.

Figure 6A:
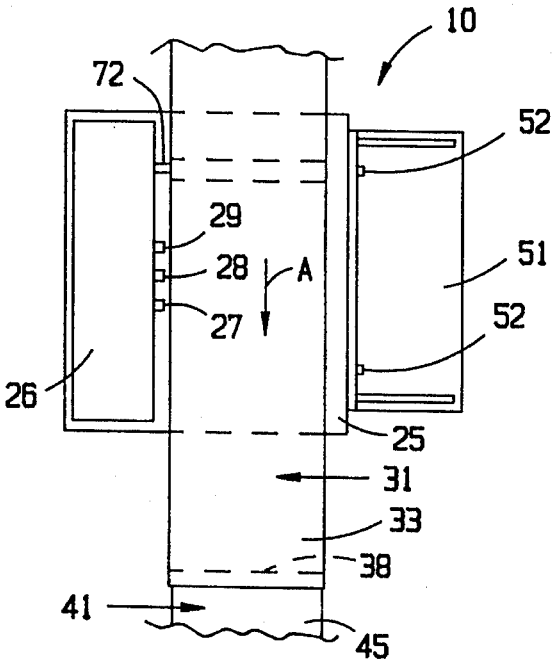
FIGS. 6A and 6B are detail views used to illustrate how the conveyor system of FIGS. 1–5 may be adapted for either left-hand or right-hand operation.

FIG. 6A shows the part of system 10 that includes the base comprising pedestal 25 and housing 26, and tray 51. In this drawing the components of system 10 are arranged in the same manner as in FIGS. 1–5, so that groups of food products are corrected by an operator standing at the left-hand side of the system as viewed from the rear, in the direction of arrow A. In some installations, however, space may be inadequate to allow an operator to work with tray 51 in this location.

Figure 6B:
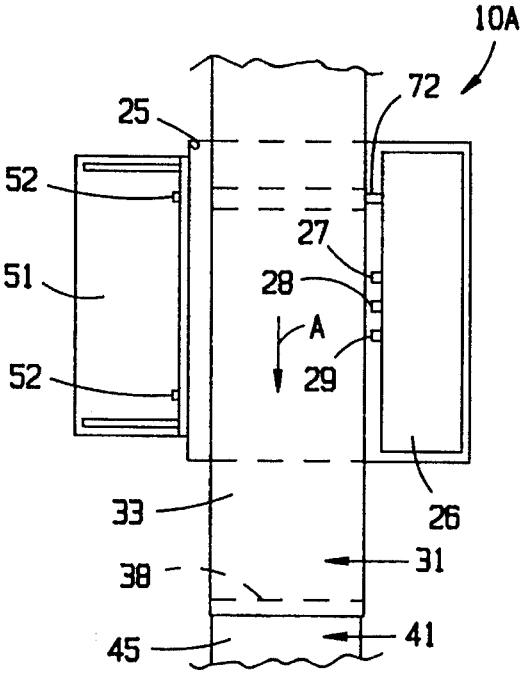

FIGS. 6B shows the same part of the takeaway/correction conveyor system in a modified arrangement 10A that places the tray 51 on the right-hand side of the system. The only substantial change is to shift the drive from one end of housing 26 to the other so that shaft 72 is located in the required position; of course, shaft 67 (FIG. 4) is similarly re-positioned. Hangers 75 and 76 (FIG. 4) should also be moved to the other end of housing 26. Thus, system 10 can be readily adapted to left-hand or right-hand use. It will also be recognized that the stand-alone system 10 can be used with different food product machines 11, so long as those machines can be made to afford appropriate speed control signals for motor 62.

We claim:

1. A stand-alone takeaway/correction conveyor system for conveying a series of groups of food products from a food product machine that produces the food product groups to a utilization position, the food product machine including measuring means for measuring the groups to distinguish reject groups from accept groups and including output means for delivering reject groups to a predetermined reject location and accept groups to a predetermined accept location displaced from the reject location, the takeaway/correction conveyor system comprising:

a base;

a reject conveyor mounted on the base and having an input end alignable with the reject location of the food product machine;

an accept conveyor mounted on the base and having an input end alignable with the accept location of the group delivery means of the food product machine and an output end alignable at a preselected utilization position;

a correction receptacle positioned adjacent the reject and accept conveyors, so that an operator can divert reject groups from the reject conveyor to the correction receptacle, correct the reject groups at the correction receptacle to form accept groups therefrom, and deposit the corrected groups on the accept conveyor;

electrically actuated drive means, in the base, for driving the reject conveyor and the accept conveyor at related speeds;

and control means for interrupting operation of the food product machine and the conveyors.

2. A takeaway/correction conveyor system according to claim 1 in which the conveyor system is physically independent of the food product machine but the drive means of the conveyor system is electrically connected to the food product machine for power and for speed control.

3. A takeaway/correction conveyor system according to claim 1 in which the control means comprises:

a first control switch, on the base, for interrupting operation of the food product machine;

and a second control switch, on the base, for interrupting operation of the conveyors and of the output means of the food product machine.

4. A takeaway/correction conveyor system according to claim 3 in which the conveyor system further comprises a third control switch, connected to the drive means, for jogging at least one of the reject and accept conveyors.

5. A takeaway/correction conveyor system according to claim 1 in which:

the reject conveyor is shorter than the accept conveyor; and the reject conveyor and the accept conveyor are parallel to each other and are vertically displaced from each other, with the reject conveyor located above the accept conveyor.

6. A takeaway/correction conveyor system, according to claim 5 in which:

the input ends of the reject and accept conveyors are each pivotally mounted on the base;

and further comprising two adjustable-length hangers each connecting the base to the input end of one of the conveyors.

7. A takeaway/correction conveyor system according to claim 6 and further comprising:

latch means for latching the input end of the reject conveyor in an elevated cleanup position.

8. A takeaway/correction conveyor system, according to claim 1 in which:

the reject conveyor includes a first drive shaft;

the accept conveyor includes a second drive shaft; and the drive means includes one electrically driven motor and drive connections from that motor to the first and second conveyor drive shafts.

9. A takeaway/correction conveyor system according to claim 1, in which the accept conveyor includes, in interconnected sequence, an input end section, a central section, and an output end section, and including means connecting the output end section of the accept conveyor to the central section so that the output end section can be displaced to a maintenance position affording access to the utilization position.

10. A takeaway/correction conveyor system according to claim 9, in which the connecting means is a pivotal connection joining the output end section to the central section of the accept conveyor.

11. A takeaway/correction conveyor system according to claim 1 and further comprising means to raise and lower the reject and accept conveyors to compensate for variations in elevation of the utilization position.

* * * * *